US006371073B1

(12) United States Patent
Billimack et al.

(10) Patent No.: US 6,371,073 B1
(45) Date of Patent: Apr. 16, 2002

(54) ISOLATED COVER WITH INDEPENDENT SEALING SYSTEM

(75) Inventors: James J. Billimack, Metamora; Paul F. Olsen, East Peoria, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/704,874

(22) Filed: Nov. 2, 2000

(51) Int. Cl.[7] ..... F02M 9/10
(52) U.S. Cl. ..... 123/195 C; 123/198 E
(58) Field of Search ..... 123/195 C, 195.5, 123/195.3, 198 E; 277/591; 181/204

(56) References Cited

U.S. PATENT DOCUMENTS

| | | | | |
|---|---|---|---|---|
| 3,396,712 A | | 8/1968 | Sakraida et al. | |
| 3,773,142 A | | 11/1973 | Bragg et al. | |
| 4,027,644 A | | 6/1977 | Timour | |
| 4,066,058 A | * | 1/1978 | Anderkay | 123/198 E |
| 4,219,002 A | * | 8/1980 | Danckert et al. | 123/198 E |
| 4,388,899 A | | 6/1983 | Shimada et al. | |
| 4,498,433 A | * | 2/1985 | Ogawa | 123/195 C |
| 4,522,165 A | * | 6/1985 | Ogawa | 123/195 C |
| 4,538,560 A | | 9/1985 | Alden | |
| 4,593,659 A | | 6/1986 | Wells et al. | |
| 4,667,628 A | | 5/1987 | Lopez-Crevillen | |
| 5,513,603 A | | 5/1996 | Ang et al. | |
| 6,085,709 A | * | 7/2000 | Freese | 123/195 C |
| 6,155,226 A | * | 12/2000 | Ozawa et al. | 123/195 C |

* cited by examiner

*Primary Examiner*—Marguerite McMahon
(74) *Attorney, Agent, or Firm*—Larry G. Cain; Schwartz & Weinrieb

(57) ABSTRACT

A vibration isolation or noise attenuation and fluid sealing system, for use in connection with internal combustion engine components. For example, for use in the mounting of a valve cover or rocker arm cover upon a cylinder block or cylinder head, or for the mounting of an oil pan cover upon an oil pan housing. The system has an isolation medium or member mechanically and/or chemically bonded to a peripheral flange portion of the cover member. A sealing flange member is chemically and/or mechanically bonded to the isolation member or medium. The three components being a one-piece unitary cover assembly. The fluid leakage along the interfaces defined between the three components is effectively eliminated. The one-piece assembly is secured to the cylinder block or head, or the oil pan housing, by shoulder bolt fasteners. The fasteners exert compressive forces upon the isolation member so as to vary the stiffness and frequency characteristics thereof. Thus, fine tuning of the stiffness can effectively absorb, dampen, and dissipate noise and vibration.

20 Claims, 1 Drawing Sheet

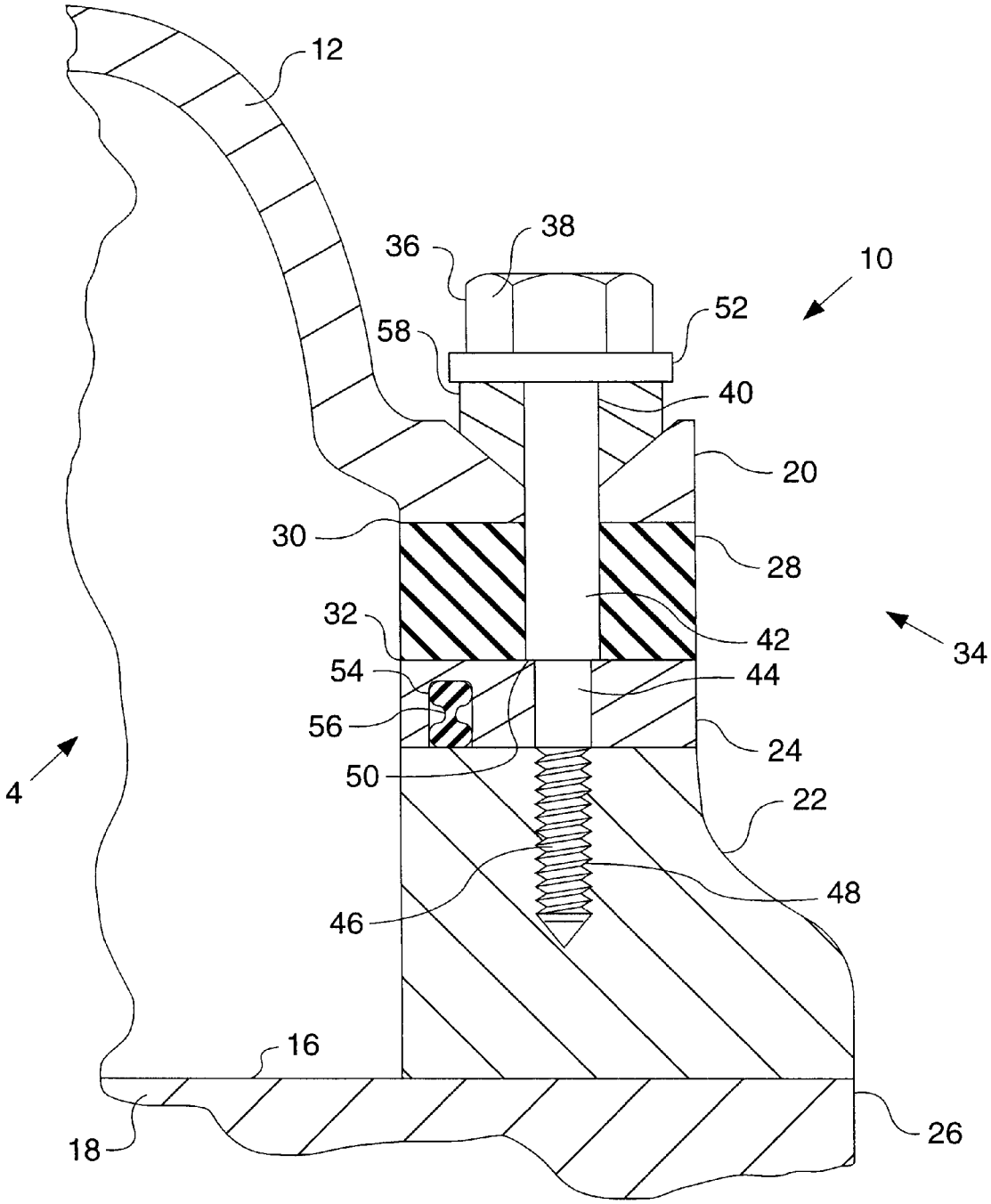
12
38
36
10
52
58
40
20
30
28
32
42
34
54
44
56
24
50
4
22
48
46
16
18
26

ISOLATED COVER WITH INDEPENDENT SEALING SYSTEM

TECHNICAL FIELD

The present invention relates generally to a vibration isolation or a noise attenuation and a fluid sealing systems, and more particularly to the use with an internal combustion engines or compressor.

BACKGROUND ART

A primary problem or difficulty encountered in the development of an operationally desirable and adequate internal combustion engine noise or vibration isolation system is the achievement of the isolation or attenuation of the noise or vibrations while preventing fluid leakage. As is well known in the art, such noise or vibration isolation systems conventionally employ some type of isolation medium which serves to absorb vibrations and thereby dampen or minimize any resulting noise or vibration transmissions. However, such isolation medium must also preserve the requisite sealing properties for the cylinder block or oil pan assembly.

Accordingly, a predetermined amount of pressure must be exerted or impressed upon the various components of the isolation system in order to achieve noise and/or vibration dampening or attenuation in combination with the sealing properties. It is well known in the art, however, that such pressure forces must be properly controlled or applied to the various components of the system in order to achieve the vibration and/or noise dampening or attenuation while preserving the integrity of the system sealing. If for example, an excessive amount of force is exerted upon the isolation medium, its stiffness characteristics are enhanced and it effectively becomes a solid member. The stiffness characteristics will more readily transmit noise and vibration, thus, reducing the effectiveness as a vibration isolator or a noise attenuation. On the other hand, if an inadequate amount of force is not exerted upon the isolation medium, fluid leakage may occur at the interface. For example, leakage could occur between the isolation medium and a cover component, or between the isolation medium and a cylinder block or an oil pan of the engine or compressor.

A need therefore exists in the art for the development of a vibration isolation or noise attenuation and fluid sealing system which can readily provide easy and desirably accurate or proper control of the pressure forces exerted or impressed upon the isolation medium of the system while preserving the sealing integrity of the system. Thus, substantially eliminating any leakage paths that would otherwise be defined or created between the isolation medium and the valve cover base, valve cover, or oil pan cover, as well as between the isolation medium and the cylinder block or oil pan.

The present invention is directed to overcome one or more of the problems as set forth above.

DISCLOSURE OF THE INVENTION

In one embodiment of the invention a vibration isolation, noise attenuation, fluid sealing system has a first member having a peripheral flange portion; a second member having a peripheral flange portion being adapted to be fixedly attached to the peripheral flange portion of the first member; a sealing flange member disposed in abutting engagement along an interface with the peripheral flange portion of the first member, and having a sealing member incorporated therein; a variably-tunable isolation member interposed the sealing flange member and the peripheral flange portion of the second member and respectively defining first and second interfaces with the sealing flange member and the peripheral flange portion of the second member; a bonding element adapted to bond the variably-tunable isolation member to the sealing flange member and the peripheral flange portion of the second member along the first and second interfaces respectively defined with the sealing flange member and the peripheral flange portion of the second flange member such that the peripheral flange portion of the second flange member, the isolation member, and the sealing flange member being a one-piece assembly, and so as to render the first and second interfaces fluid-tight; and a plurality of fasteners inserted through the peripheral flange portion of the second flange member, the isolation member, and the sealing flange member, and into the peripheral flange portion of the first flange member so as to secure the three-piece assembly to the peripheral flange portion of the first member while exerting predetermined compressive forces upon the isolation medium so as to variably alter the stiffness characteristics of the isolation member and thereby tune the isolation member to frequencies which enable dampening of noise and vibrations having predetermined frequencies.

And in another embodiment, a vibration isolation, noise attenuation, and fluid sealing system for use in connection with internal combustion engine components, has a first member having a peripheral flange portion. A second member has a peripheral flange portion adapted to be fixedly attached to the peripheral flange portion of the first member. A sealing flange member is disposed in abutting engagement along an interface with the peripheral flange portion of the first member, and has a sealing member incorporated therein for sealing the interface defined between the sealing flange member and the peripheral flange portion of the first member. A variably-tunable isolation member is interposed the sealing flange member and the peripheral flange portion of the second member and respectively defines a first and second interfaces with the sealing flange member and the peripheral flange portion of the second member. A bond element is adapted to bond the variably-tunable isolation member to the sealing flange member and the peripheral flange portion of the second member along the first and second interfaces respectively defined with the sealing flange member and the peripheral flange portion of the second flange member. The peripheral flange portion of the second flange member, the isolation member, and the sealing flange member is an one-piece assembly. And renders the first and second interfaces fluid-tight. And, a plurality of fasteners are inserted through the peripheral flange portion of the second flange member, the isolation member, and the sealing flange member, and into the peripheral flange portion of the first flange member. The plurality of fasteners secure the one-piece assembly to the peripheral flange portion of the first member while exerting predetermined a compressive forces upon the isolation medium. The predetermined compressive forces variably alter the stiffness characteristics of the isolation member and tune the isolation member to frequencies which enable dampening of noise and vibrations having predetermined frequencies.

BRIEF DESCRIPTION OF THE DRAWINGS

The FIG. 1 is a cross-sectional view of a vibration isolation or noise attenuation and fluid sealing system of the embodiment of the present invention being used with an internal combustion engine or compressor.

BEST MODE FOR CARRYING OUT THE INVENTION

Referring now to FIG. 1, a vibration isolation or noise attenuation and fluid sealing system 10 is shown. And, is used in connection with a cover member 12, such as, a valve cover base, a valve covers, and/or an oil pan covers of an internal combustion engine or compressor 14 cylinder blocks 16 or an flywheel housing 18. The cover member 12 has a peripheral flange portion 20 fixedly secured to a mating peripheral flange or upstanding wall portion 22 of an engine cylinder block 16 or flywheel housing 18. The cover member 12, and of course its peripheral flange portion 20, may be fabricated, for example, from a suitable metal, thermoplastic material or the like, although die-cast aluminum is preferable. In order to vibrationally isolate the cover member 12 from the vibrational frequencies and noise emanating from the moving parts of the engine, a sealing flange member 24 is interposed between the mating flange or upstanding wall portion 22 of an engine cylinder head 26 or the block 16 and the peripheral flange portion 20 of the cover member 12. The sealing flange member 24 is fabricated from a suitable material which is compatible with or the same as the material from which the cover member 12, and its peripheral flange portion 20, is fabricated. In addition to such aforenoted structure, an isolation medium or member 28, which may be fabricated from a suitable elastomeric or rubber material, is interposed the sealing flange member 24 and the peripheral flange portion 20 of the cover member 12.

The peripheral flange portion 24 of the cover member 12 is affixed and fluidically sealed with respect to the isolation medium or member 28. And, in a similar manner, the isolation medium or member 28 is affixed and fluidically sealed with respect to the sealing flange member 24. A mechanical and/or chemical bonding element 30 is interposed between the peripheral flange portion 20 of the cover member 12 and the isolation medium 28. And, a similar mechanical and/or chemical bonding element 32 is interposed between the isolation medium 28 and the sealing flange 24. The mechanical bonding may take the form of physically intercooperating structure, such as, a mechanical fasteners, a groove and dovetail structure defined upon the respective abutting members, female bores or apertures defined within one of the abutting members and rubber male members provided upon the other one of the abutting members and projecting into the female bores or apertures defined within the first abutting member, or the like. The chemical bonding may of course use a suitable adhesive.

As a result of the aforenoted structure, it is to be appreciated that the cylinder block 16 or valve cover base, valve cover, or oil pan cover 12, or more specifically, the peripheral region of the cylinder block 16 or valve cover base, valve cover, or oil pan cover 12, has an integral one-piece, fluid-tight cover assembly 34. The integral one-piece assembly 34 includes the peripheral flange portion 20 of the cylinder block 16 or valve cover base, valve cover, or oil pan cover 12, the isolation medium 28, and the sealing flange 24. Fluid leakage from the interior of the cylinder block 16 or head 26, or flywheel housing 18, at the interfaces defined between the peripheral flange portion 20 of the cover member 12 and the isolation medium or member 28, as well as between the isolation medium or member 28 and the sealing flange 24, is effectively prevented.

In order to fixedly attach or secure the aforenoted three-piece cover assembly 34 to the upstanding mating flange 22 of the cylinder block 16 or flywheel housing 18, a plurality of bolts 36, only one of which is shown, are provided at predetermined locations defined around the periphery of the cylinder block 16 or valve cover base, valve cover, or oil pan cover 12, as well as, of course, around the periphery of the cylinder block 16 or cylinder head 26, or flywheel housing 18. In this application, each bolt is a shoulder bolt 36 has a hexagonal head portion 38, and a shank portion 40 which has an upper, relatively large diameter, non-threaded shank portion 42 and a lower, relatively small diameter shank portion 44. The lowermost end or section of the lower, relatively small diameter shank portion 44 is threaded, as at 46. The threads 46 engage with a threaded blind bore 48 defined within the upstanding mating flange portion 22 of the cylinder block 16 or flywheel housing 18.

An annular shoulder portion 50 is defined upon the bolt shank at the axial position of the bolt 36 at which the relatively large diameter and relatively small diameter shank portions 42 and 44 interface. The purpose to be discussed and made apparent when the actual assembly of the entire isolation and fluid sealing system 10 is described. An annular flange portion 52 is similarly provided at the axial position of the bolt 36 at which the relatively large diameter, non-threaded shank portion 42 and hexagonal head portion 38 interface. The purpose to likewise be discussed and made apparent when the actual assembly of the entire isolation and fluid sealing system 10 is described.

The shoulder bolts 36 of this application can be formed by many alternatives. For example, a conventional bolt and washer could be used with channel shaped sleeve. Or, a conventional bolt and washer could be used with a cylindrical spacer or sleeve.

The sealing flange 24 is provided with an annular recess 54 within which is disposed a suitable sealing member 56 which may have, for example an O-ring, a gasket, or the like. The sealing member 56 normally projects outwardly from the annular recess 54 toward the upper surface of the upstanding wall portion or mating flange 22 of the cylinder block 16 or head 26, or flywheel housing 18 prior to sealing engagement of the valve cover base, valve cover, or oil pan cover member 12 upon the cylinder head 26 or block 16, or flywheel housing 18. The sealing member 56 may be readily compressed to a predetermined degree back into the recess 54 and into sealing engagement with the upper surface of the upstanding wall portion or mating flange 22 of the cylinder block 16 head 26 or flywheel housing 18 upon sealing engagement of the valve cover base, valve cover, or oil pan cover member 12 upon the cylinder block 16 head 26 or flywheel housing 18. A grommet 58 is interposed the annular flanged portion 52 of each bolt fastener 36 and the peripheral flange portion 20 of the cover member 12.

Industrial Applicability

When the valve cover base, valve cover, or oil pan cover member 12 is to be mounted upon the cylinder block 16 or head 26, or flywheel housing 18 in the desired fluid-tight sealed manner, the plurality of shoulder bolts 36 are inserted through the aforenoted integral, three-piece cover assembly 34 of the valve cover base, valve cover, or oil pan cover member 12. The lower threaded end portion 46 of each shoulder bolt 36 is respectively threadedly engaged within one of the threaded blind bores 48 of the cylinder head 26 or block 16, or flywheel housing 18. As a result of the threaded engagement of the lower threaded end portions 46 of the shoulder bolt fasteners 36 within the threaded blind bores 48 of the cylinder head 26 or block 16, or flywheel housing 18, the hexagonal head portions 38, and the annular flanged portions 52, of the shoulder bolt fasteners 36 exert downwardly directed forces upon the peripheral flange portion 20 of the cover member 12. The sealing flange member 24 is forced into abutting engagement with the upstanding mating flange portion 20 of the cylinder head 26 or block 16, or flywheel housing, 18, and the sealing member 56 is compressed into sealing engagement with the upper surface of the upstanding mating flange portion 20 of the cylinder head 26 or block 16, or flywheel housing 18.

A predetermined amount of such aforenoted threaded engagement of the lower threaded end portions 46 of the shoulder bolt fasteners 36 within the threaded blind bores 48 of the cylinder head 26 or block 16, or flywheel housing 18, and the abutting engagement of the sealing flange member 24 with the upstanding mating flange portion 22 of the cylinder head 26 or block 16, or flywheel housing, 18, the isolation medium or member 28 is compressed to a predetermined degree. The stiffness characteristics of the same are predeterminedly altered or varied so as to, in effect, specifically tune such medium or member 28 to particular frequencies relatively different from the frequencies of the noise and vibrations which emanate from the operative parts of the engine 14. The noise and vibrations will be effectively absorbed, dampened, or dissipated so as not to be transmitted throughout the cylinder head 26 or block 16, or oil pan, structure. In addition to the aforenoted structure, the grommet 58 is interposed the annular flanged portion 52 of each bolt fastener 36 and the peripheral flange portion 20 of the cover member 12. The grommet 58 provides additional variables in connection with the pressure forces exerted or impressed upon the three-piece cover assembly 34 ion tuning the same with respect to the aforenoted specific noise and vibration frequencies.

More particularly, when the shoulder bolt fasteners 36 are tightened to their desired degree of torque as a result of the lower threaded end portions 46 of the shoulder bolt fasteners 36 being properly seated or threadedly engaged within the blind bores 48 of the cylinder head 26 or block 16, or flywheel housing, 18, the three-piece cover assembly 34 will be able to "float" upon the grommet 58. The axial lengths of the upper, relatively large diameter, nonthreaded shank portions 42 of the shoulder bolt fasteners 36 are such that when the shoulder bolt fasteners 36 are in fact fully or properly torqued, and seated upon or threadedly engaged with the blind bores 48 of the upstanding mating flange portion 22 of the cylinder head 26 or block 16, or flywheel housing, 18, the annular shoulder portion 50 of each shoulder bolt fastener 36 will engage the upper surface of the sealing flange member 24. This retains the sealing flange member 24 in fluid-tight engagement or abutment with the upper surface of the upstanding mating flange portion 22 of the cylinder head 26 or block 16, or flywheel housing, 18 as well as prevents excessive compression of the isolation medium or member 28.

The vibration isolation or noise attenuation and fluid sealing system 10 has been developed to prevent fluid leakage paths between the isolation medium member 28 and its abutting flange members 16, 18, 26. The mounting and assembly of the system 10 permits fine variable tuning of the isolation medium member 28 so as to effectively dampen, absorb, or dissipate noise and vibrations emanating from the operative or moving parts of the internal combustion engine or compressor 14. Such noise and vibrations are eliminated from being transmitted throughout the particular structure or assembly in connection with which the system 10 of the present invention.

Other aspects, objects and advantages of this invention can be obtained from a study of the drawings, the disclosure and the appended claims.

What is claimed is:

1. A vibration isolation, noise attenuation, fluid sealing system, comprising:

a first member having a peripheral flange portion;

a second member having a peripheral flange portion being adapted to be fixedly attached to said peripheral flange portion of said first member;

a sealing flange member disposed in abutting engagement along an interface with said peripheral flange portion of said first member, and having a sealing member incorporated therein for sealing said interface defined between said sealing flange member and said peripheral flange portion of said first member;

a variably-tunable isolation member interposed between said sealing flange member and said peripheral flange portion of said second member and respectively defining first and second interfaces with said sealing flange member and said peripheral flange portion of said second member;

a bonding element adapted to bond said variably-tunable isolation member to said sealing, flange member and said peripheral flange portion of said second member along said first and second interfaces respectively defined with said sealing flange member and said peripheral flange portion of said second flange member such that said peripheral flange portion of said second flange member, said isolation member, and said sealing flange member being a one-piece assembly, and so as to render said first and second interfaces fluid-tight; and a plurality of fasteners inserted through said peripheral flange portion of said second flange member, said isolation member, and said sealing flange member, and into said peripheral flange portion of said first flange member so as to secure said one-piece assembly to said peripheral flange portion of said first member while exerting predetermined compressive forces upon said isolation medium so as to variably alter the stiffness characteristics of said isolation member and thereby tune said isolation member to frequencies which enable dampening of noise and vibrations having predetermined frequencies.

2. The system as set forth in claim 1, wherein said first member being a cylinder head and said second member being a valve cover.

3. The system as set forth in claim 1, wherein said first member being a cylinder block and said second member being a rocker arm cover.

4. The system as set forth in claim 1, wherein said first member being an oil pan housing and said second member being an oil pan cover.

5. The system as set forth in claim 1, wherein said isolation member is fabricated from an elastomeric rubber material.

6. The system as set forth in claim 1, wherein said sealing member of said sealing flange member being an O-ring member.

7. The system as set forth in claim 1, wherein said sealing member of said sealing flange member being an annular gasket.

8. The system as set forth in claim 1, wherein each one of said plurality of fasteners being a bolt fastener having a threaded portion at a first end thereof for threadedly engaging said peripheral flange portion of said first member, and a head portion at a second opposite end thereof for exerting compressive forces upon said peripheral flange portion of said second member as said first threaded end portion of said bolt fastener is threadedly engaged within said peripheral flange portion of said first member, wherein said compressive forces are transmitted to said isolation medium so as to predeterminedly alter said stiffness and frequency characteristics of said isolation medium.

9. The system as set forth in claim 8, including a grommet interposed said head portion of said bolt fastener and said peripheral flange portion of said second member for transmitting said compressive forces exerted by said head portion of said bolt fastener to said peripheral flange portion of said second member and to said isolation member.

10. The system as set forth in claim 8, wherein said bolt fastener having a shoulder bolt fastener which has a shoulder portion for engaging said sealing flange member so as to prevent excessive compression of said isolation member.

11. The system as set forth in claim 1, wherein said bonding element being a chemical adhesive.

12. The system as set forth in claim 1, wherein said bonding element being a mechanical tongue and groove members.

13. A vibration isolation, noise attenuation, and fluid sealing system for use in connection with internal combustion engine components, comprising:

a first member having a peripheral flange portion;

a second member having a peripheral flange portion adapted to be fixedly attached to said peripheral flange portion of said first member;

a sealing flange member disposed in abutting engagement along an interface with said peripheral flange portion of said first member, and having a sealing member incorporated therein for sealing said interface defined between said sealing flange member and said peripheral flange portion of said first member;

a variably-tunable isolation member interposed said sealing flange member and said peripheral flange portion of said second member and respectively defining first and second interfaces with said sealing flange member and said peripheral flange portion of said second member;

a bonding element being adapted to bond said variably-tunable isolation member to said sealing flange member and said peripheral flange portion of said second member along said first and second interfaces respectively defined with said sealing flange member and said peripheral flange portion of said second flange member such that said peripheral flange portion of said second flange member, said isolation member, and said sealing flange member being a one-piece assembly, and so as to render said first and second interfaces fluid-tight; and a plurality of fasteners inserted through said peripheral flange portion of said second flange member, said isolation member, and said sealing flange member, and into said peripheral flange portion of said first flange member so as to secure said one-piece assembly to said peripheral flange portion of said first member while exerting predetermined compressive forces upon said isolation medium so as to variably alter the stiffness characteristics of said isolation member and thereby tune said isolation member to frequencies which enable dampening of noise and vibrations having predetermined frequencies.

14. The system as set forth in claim 13, wherein said first member being an internal combustion engine cylinder head and said second member being an internal combustion engine valve cover.

15. The system as set forth in claim 13, wherein said first member being an internal combustion engine cylinder block and said second member being an internal combustion engine rocker arm cover.

16. The system as set forth in claim 13, wherein said first member being an internal combustion engine oil pan housing and said second member being an internal combustion engine oil pan cover.

17. The system as set forth in claim 13, wherein said isolation member is fabricated from an elastomeric rubber material.

18. The system as set forth in claim 13, wherein said sealing member of said sealing flange member being an O-ring member.

19. The system as set forth in claim 13, wherein said sealing member of said sealing flange member being an annular gasket.

20. The system as set forth in claim 13, wherein each one of said plurality of fasteners being a bolt fastener having a threaded portion at a first end thereof for threadedly engaging said peripheral flange portion of said first member, and a head portion at a second opposite end thereof for exerting compressive forces upon said peripheral flange portion of said second member as said first threaded end portion of said bolt fastener is threadedly engaged within said peripheral flange portion of said first member, wherein said compressive forces are transmitted to said isolation medium so as to predeterminedly alter said stiffness and frequency characteristics of said isolation medium.

* * * * *

UNITED STATES PATENT AND TRADEMARK OFFICE

CERTIFICATE OF CORRECTION

PATENT NO. : 6,371,073 B1
DATED : April 16, 2002
INVENTOR(S) : James J. Billimack et al.

It is certified that error appears in the above-identified patent and that said Letters Patent is hereby corrected as shown below:

Column 6,
Line 14, remove the comma (,) after the word "sealing".

Signed and Sealed this

Twenty-fifth Day of June, 2002

*Attest:*

*Attesting Officer*

JAMES E. ROGAN
*Director of the United States Patent and Trademark Office*